United States Patent [19]

Barowitz et al.

[11] 4,090,180

[45] May 16, 1978

[54] VIBRATION-RESPONSIVE INTRUDER ALARM SYSTEM

[75] Inventors: Peter Jack Barowitz, Welwyn; Roy Baxendale, Harpenden, both of England

[73] Assignee: Elliott Brothers (London) Limited, Chelmsford, England

[21] Appl. No.: 776,439

[22] Filed: Mar. 11, 1977

[30] Foreign Application Priority Data

Mar. 16, 1976 United Kingdom ..... 10494/76

[51] Int. Cl.[2] ..... G08B 13/22

[52] U.S. Cl. ..... 340/261; 340/258 R

[58] Field of Search ..... 340/261, 258 R

[56] References Cited

U.S. PATENT DOCUMENTS 3,686,658 8/1972 Wilt ..... 340/261

3,696,369 10/1972 Laymon et al. ..... 340/261

*Primary Examiner*—Glen R. Swann, III

*Attorney, Agent, or Firm*—Kirschstein, Kirschstein, Ottinger, Frank & Cobrin

[57] ABSTRACT

Electric signals in two narrow frequency bands arising from ground or airborne vibrations incident on one or more geophones at the perimeter of an area to be protected are monitored and an alarm given if signal components that are indicative of human footsteps near the geophones occur in both frequency bands two or more times within a predetermined period. These signal components comprise bursts of oscillations having steep leading edges and durations of some thirty to one hundred milliseconds, and there are provided means to rectify these bursts and to detect resulting pulse waveforms.

4 Claims, 3 Drawing Figures

VIBRATION-RESPONSIVE INTRUDER ALARM SYSTEM

BACKGROUND OF INVENTION

The present invention relates to intruder alarm systems.

In intruder alarm systems in which acoustic or other vibrations arising from the movements of an intruder within a protected area are sensed by one or more electro-mechanical transducers which provide electric signals from which an alarm condition may be recognised, it is necessary reliably to distinguish vibrations caused by a human intruder from those from other sources, such as rain or hail, small animals or nearby road, rail or air traffic, so as to avoid too many false alarms.

It is also necessary sometimes to avoid giving an alarm if vibrations resulting from human movements are detected but are found to be from outside the protected area.

SUMMARY OF THE INVENTION

According to one aspect of the present invention an intruder alarm system comprises one or more electro-mechanical transducers providing electric signals in response to vibrations incident upon said one or more transducers, which electric signals may extend over a range of frequencies, filter means to select electric signal components in a band of frequencies within said range, means to rectify said selected signal components to provide a first electric waveform, means to derive a second electric waveform which tends to follow said first waveform but with slowed rise times, and detector means to give an output signal if said first waveform exceeds said second waveform in magnitude by more than a predetermined amount for longer than a predetermined period.

According to another aspect of the present invention an intruder alarm system comprises one or more transducers providing electric signals in response to vibrations incident upon said one or more transducers, which electric signals may extend over a range of frequencies, first and second bandpass filter means arranged to pass signal components in respective bands of frequencies within said range, respective means to rectify said signal components to provide first and second electric waveforms, and first and second detector circuit means each responsive to give an output signal if the respective electric waveform exceeds a respective reference signal for longer than a predetermined period.

Preferably said system gives an alarm indication in response to substantially coincident output signals from said detector circuit means. Each reference signal may be derived at least in part from the respective electric waveform.

An intruder alarm system in accordance with the present invention will now be described by way of example with reference to the accompanying drawing, of which:

DESCRIPTION OF THE PREFERRED EMBODIMENTS

Figure 1:
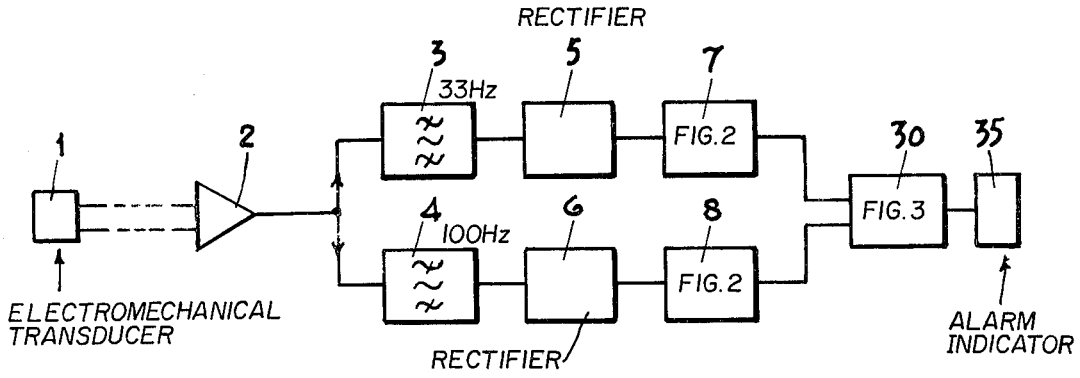
FIG. 1 shows the system schematically.

Referring first to FIG. 1 the intruder alarm system comprises one or more electro-mechanical transducers, represented by the block 1, which are arranged to provide electric signals in response to mechanical or acoustic vibrations incident upon said transducers. These transducers, sometimes known as geophones, may be attached to posts or walls or buried in the ground within the area to be protected by the alarm system, and may be connected either in common or individually to broadband amplifiers represented by the block 2.

In response to footsteps or other causes of ground-borne or acoustic vibrations within or near the protected area the transducers 1 receive vibrations and derive analogous electric signals, extending over a range of frequencies, the signals of interest for intruder detection ranging from say 15 to 150 Hertz. The electric signals, after amplification, are applied to two narrow-band filters 3 and 4 having pass-bands some 12 and 37 Hertz wide respectively centred on 33 Hertz and 100 Hertz respectively.

Figure 2:
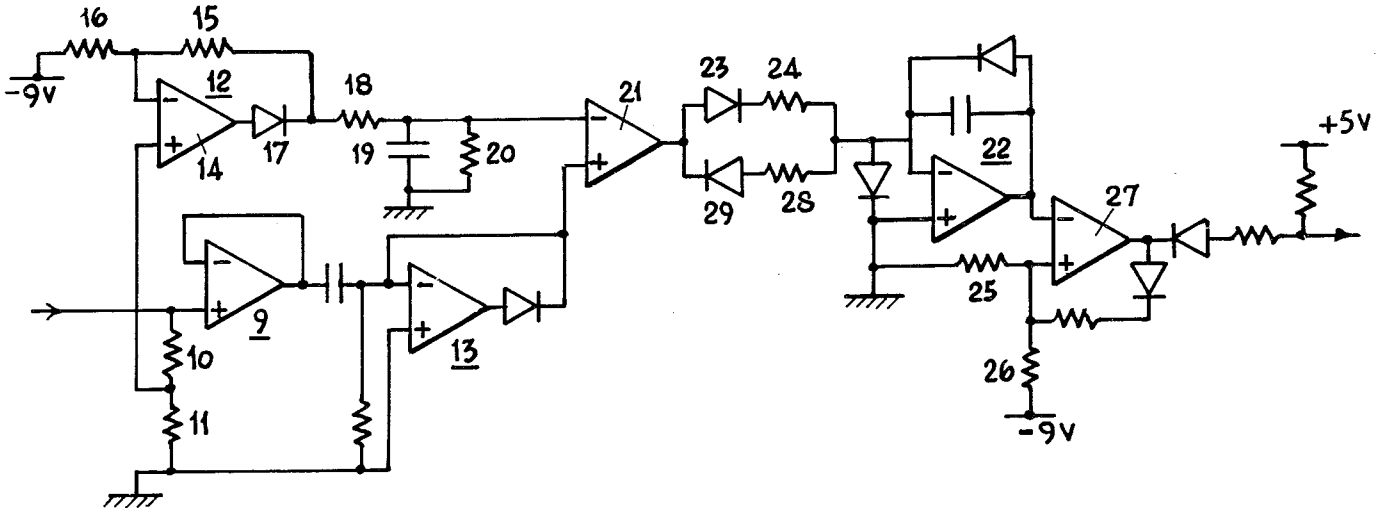

The output signals from these filters are envelope detected, or halfwave rectified, at 5 and 6 respectively and the rectified signals applied to respective circuits 7 and 8 for detecting elements in these signals which indicate a human footstep, one of these circuits being shown diagrammatically in FIG. 2.

The rectified signals in general comprise a succession of spikes representing a background of vibrations incident upon the transducers 1, each spike made up of or extending over a few half-cycles of the selected frequency. Rectified signals including components originating from an impact, such as a footstep, on the surface of the ground within range of the transducers 1 have superimposed on this background a pulse signal having a steep leading edge and a duration typically of the order of 30 to 100 milliseconds, and the system may be arranged so that two such pulse signals occurring within an interval of, say, 5 seconds gives rise to an alarm indication.

Referring now to FIG. 2, which shows one of the circuits 7 and 8, rectified signals are applied directly to a unity-gain stage 9 and, by way of voltage dividing resistors 10 and 11, to an input of an envelope shaping circuit 12. The stage 9 is followed by a d.c. restorer and compressor stage 13.

The envelope shaping circuit 12 comprises an amplifier 14 having a feedback path to its inverting input by way of a resistor 15 and a connection to that inverting input by way of a resistor 16 from a negative bias voltage source, such that the output signals of the amplifier 14, at the cathode of a diode 17 in its output path, are set at a d.c. level some 30 to 50 millivolts positive with respect to earth. The proportion, some two thirds, of the rectified signal voltage that is applied to the circuit 12 is superimposed on this d.c. level at the cathode of the diode 17, and the composite signal is applied by way of a resistor 18 to charge a capacitor 19. The time constant of the resistor 18 with the capacitor 19 is several times as long as the rise time of any significant component of the rectified signals, and the effect is to produce a voltage waveform across the capacitor 19 which tends to follow that at the cathode of the diode 17 but with slowed rise-times. When the instantaneous value of the composite waveform falls, the capacitor 19 discharges by way of a resistor 10 which has a value an order of magnitude greater than that of the resistor 18, so that the fall times tend to be slowed more than the rise times.

It will be appreciated therefore that when a pulse signal occurs the voltage waveform applied by the circuit 12 to the inverting input of a differential amplifier 21, which amplifier acts as a comparator, will start from a higher base level but rise at a slower rate than the original signal, as represented by the output signal from the stage 13. The instantaneous value of the waveform from the circuit 12 will therefore be higher than that of the original signal except when this original signal rises quickly for more than a predetermined time, the rate of rise being restricted of course by the narrow bandwidth. These exceptions are characteristic of the vibration patterns which are of interest in detecting intruders.

If the comparator amplifier 21 detects one of these high-rising transients the resulting voltage changeover at its output applies a positive potential to an integrator circuit 22 by way of a diode 23 and resistor 24 whereby the output voltage of the integrator circuit 22 commences going negative. If the trnsient is the leading edge of a pulse of longer than a given duration, which would be characteristic of signals arising from a human footstep, the output voltage of the integrator 22 passes the voltage set by divider resistors 25 and 26 in an input circuit of a second comparator 27, and this comparator 27 thereupon changes its output state to register the event. When the pulse ends the integrator 22 is returned to its initial condition by current flow through a resistor 28 and a diode 29 into the output of the amplifier 21.

Figure 3:
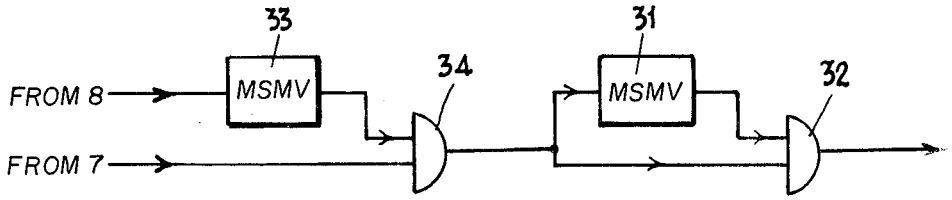
FIGS. 2 and 3 show in greater detail respective parts of the system shown in FIG. 1.

Referring again to FIG. 1, it has been found that human footsteps within a given range of the transducers 1 tend to give rise to these longer pulses within both the 30 Hertz band and the 100 Hertz band, whereas other sources of vibration do not. Apart from slight dispersion effects which cause the 100 Hertz components to arrive at the transducer 1 before the 33 Hertz components, a human footstep within limited range of the transducers therefore gives rise to coincident events, as detected by the respective comparators 27, and a circuit 30 is provided to detect and count such coincidences. This circuit 30 is shown in more detail in FIG. 3. Since just two events in 5 seconds may be sufficient to justify an alarm being given the circuit 30 comprises a monostable circuit 31 which resets itself after a 5 second delay. A first event is then arranged to set this monostable circuit 31 and a second event occurring before the monostable circuit has reset is detected by an "And" gate 32, which is arranged to apply an alarm signal to an indicator 35, which may for example comprise a warning lamp and an audible alarm. To overcome the dispersion effect a 100 Hertz event is arranged to set a monostable circuit 33, which resets itself after a period off 150 milliseconds. If a 33 Hertz event occurs within this period a coincident event output is provided by an "And" gate 34.

It will be appreciated that the transducers 1 may be arranged either to detect footsteps within a general area or within a strip-like area defining the perimeter of a protected area, the two events in 5 seconds facility being particularly aimed at detecting intruders crossing a perimeter strip.

We claim:

1. An intruder alarm system comprising at least one electromechanical transducer providing electric signals in response to vibrations incident on said transducer, said electric signals extending over a range of frequencies, filter means to select electric signal components in a band of frequenies within said range, means to rectify said selected signal components to provide a first electric waveform, means to derive a second electric waveform which tends to follow said first waveform but with slowed rise times, and detector means to give an output signal if said first waveform exceeds said second waveform in magnitude for longer than a predetermined period.

2. An intruder alarm system in accordance with claim 1 wherein said means to derive said second waveform comprises means to apply a voltage proportional to said first waveform, together with a constant voltage, to charge a capacitor, the voltage across said capacitor acting as said second electric waveform.

3. An intruder alarm system in accordance with claim 1 wherein the detector means comprises a voltage comparator, integrator means connected to an output of said comparator, and threshold detector means connected to an output of said integrator means.

4. An intruder alarm system comprising at least one transducer providing electric signals in response to vibrations incident upon said transducer, said electric signals extending over a range of frequencies, first and seond band-pass filter means arranged to select signal components in respective bands of frequencies within said range, respective means to rectify said selected signal components to provide respective first electric waveforms, respective means to derive respective second electric waveforms which tend to follow the respective first waveforms but with slowed rise times, respective detector means each arranged to give an output signal if the respective first waveform exceeds the respective second waveform in magnitude by more than a predetermined amount for longer than a predetermined time, and means to give an alarm indication in response to substantially coincident output signals from said detector means.

* * * * *